US005527611A

United States Patent [19]

Hernandez

[11] Patent Number: 5,527,611

[45] Date of Patent: Jun. 18, 1996

[54] RELATING TO HOLLOW FIBER IDENTIFICATION

[75] Inventor: Ismael A. Hernandez, Winterville, N.C.

[73] Assignee: E. I. Du Pont de Nemours and Company, Wilmington, Del.

[21] Appl. No.: 458,945

[22] Filed: Jun. 2, 1995

Related U.S. Application Data

[63] Continuation-in-part of Ser. No. 204,054, Mar. 2, 1994, abandoned, which is a continuation-in-part of Ser. No. 17,546, Feb. 16, 1993, abandoned.

[51] Int. Cl.[6] ..... D02G 3/00

[52] U.S. Cl. ..... 428/376; 428/92; 428/397; 428/398

[58] Field of Search ..... 428/376, 397, 428/398, 92

[56] References Cited

U.S. PATENT DOCUMENTS

| | | | |
|---|---|---|---|
| 3,772,137 | 11/1973 | Tolliver | 57/140 |
| 4,743,189 | 5/1988 | Samuelson . | |
| 4,850,847 | 7/1989 | Samuelson . | |
| 4,861,661 | 8/1989 | Samuelson . | |
| 4,941,812 | 7/1990 | Samuelson . | |
| 4,956,237 | 9/1990 | Samuelson . | |
| 5,104,725 | 4/1992 | Broaddus | 428/398 |

FOREIGN PATENT DOCUMENTS

| | | |
|---|---|---|
| 5756512 | 4/1982 | Japan . |

*Primary Examiner*—N. Edwards

[57] ABSTRACT

Hollow fibers are differentiated by their void being partially filled with a differentiating characteristic that is a protuberance of characterizing polymer material. This material may be the same or different from that of the rest of the fiber. The protuberance is provided by appropriate adjustment of the spinning capillary, i.e., during extrusion to form the fiber.

4 Claims, 4 Drawing Sheets

RELATING TO HOLLOW FIBER IDENTIFICATION

CROSS REFERENCE TO RELATED APPLICATION

This application is a continuation-in-part of my application Ser. No. 08/204,054, filed Mar. 2, 1994, now abandoned, and that is itself a continuation-in-part of my application Ser. No. 08/017,546, filed Feb. 16, '1993, now abandoned.

FIELD OF INVENTION

This invention concerns improvements in and relating to fiber identification, and includes a novel method of making a hollow fiber with a characteristic by which it can later be identified, novel hollow fibers so marked as to be identifiable, and products and materials including such marked fibers, especially fiberfill filling materials (often referred to shortly as "fiberfill") and products, including batts, fiberballs and other products comprising such marked fibers and materials comprising them, and processes and apparatus for obtaining such hollow fibers and their products and materials.

BACKGROUND OF THE INVENTION

A fiber manufacturer's customers demand consistency in performance from the fibers provided by the manufacturer. In other words, the manufacturer's customers require that the properties of any particular fiber not vary appreciably from batch to batch of that fiber as the different batches of that fiber are produced over several years. The fiber manufacturer, however, has a need to be able to identify fiber from different production batches, while maintaining the consistency and uniformity that the customers require. Much notoriety has been given to fiber identification in criminology, for example, as a way to bring murderers or other criminals to justice. Manufacturers also, however, have other more mundane and practical reasons for needing to identify the production batch of particular fibers. So it has long been desirable to find a cheap yet effective system for identifying fibers. Previously, for instance, one method has been to add a chemical or nuclear marker to the fiber, but this method has added expense and complications and has had disadvantages, such as the ease with which some one other than the fiber manufacturer can add the same marker, after manufacture, and so confuse this system for identification.

In particular, there has long existed a need for an economical way to identify and differentiate resilient hollow fibers (especially polyester hollow fibers) that are crimped and used as fiberfill in products such as baits, fiberballs and other filling materials and filled articles, such as pillows, filled apparel, comforters, cushions and such like bedding and furnishing material. Such crimped hollow fibers have a single continuous void throughout the fiber length and include those disclosed by Tolliver in U.S. Pat. No. 3,772,137, having a void content of about 13 percent to about 25 percent, and a crimp frequency of about 5 to about 12 crimps per inch (about 2 crimps per cm to about 5 crimps per cm), and a crimp index of about 25 to about 35. As indicated, it is important that any identifier system should not change the performance and properties of the fibers.

SUMMARY OF THE INVENTION

The present invention solves this need to identify and differentiate hollow fibers by providing a visual identifying marker in the configuration of the cross-section of the hollow fiber. This marker identifies the hollow fiber only visually, i.e., without significantly affecting performance of the fiber. Fibers with such a visual identifying marker according to the present invention are often referred to herein as "identifier fibers" (or "identifier filaments").

The terms "fiber" and "filament" are often used herein inclusively, without intending that use of one term should exclude the other.

Accordingly, this invention provides hollow fibers that are of a synthetic polymer, and that have a single continuous void throughout their fiber length, a void content of up to 30%, and a hollow cross-section that shows characteristic polymer material that protrudes into the single continuous void from an inside surface of the single continuous void, said hollow cross-section having a degree of irregularity (as defined herein) of less than 5%.

A degree of irregularity of a hollow cross-section of a hollow fiber is defined hereby in the same sense as defined in Japanese Patent Application Publication Kokai 57-56512 (Applicant Nippon Ester Co., Ltd., Inventors Yoshifumi Moriguchi and Junji Ikeda, hereinafter "Moriguchi", published Apr. 5, 1982); namely, the degree of irregularity of a hollow cross-section having a protruding part that protrudes into the hollow cross-section from an inside surface is calculated, as a percentage, by dividing the area of the protruding part by the sum of the area of the protruding part and of the area of the hollow section (and multiplying×100 to get the percentage). Moriguchi illustrates this definition by reference to his FIG. 2 that explains how to determine the degree of irregularity. Moriguchi distinguishes between the area of the protruding part, and the area of the hollow section (i.e., the cross-sectional area of the void). A translation into English of Moriguchi has been provided for the record in Applicant's parent application.

According to other aspects disclosed herein, fiberfill (and including filled articles thereof) is provided wherein said fiberfill comprises resilient crimped hollow filling fibers of synthetic polymer, and wherein, e.g., at least 10 percent by weight of said fibers have a single continuous void throughout the fiber length, and have a cross-section which shows that characteristic polymer material protrudes from a wall (i.e., from an inside surface of such void) into such void, whereby said characteristic protruding polymer material differentially identifies said fiber from similar synthetic polymer fibers that do not contain any such protruding polymer material but does not significantly differentiate the performance properties (as filling material) of said fiber from said similar fibers.

Thus, according to the invention, polymer material protruding from the internal surface of the single void of a (first) fiber of a synthetic material is used to identify said (first) fiber and differentiate it from other hollow fibers of similar cross-section and having similar performance characteristics to those of the first (identified and differentiated) fiber, except, of course, that the other fibers do not have the polymer material protruding from the internal surface of the wall of the fiber.

Other aspects include methods, apparatus and products disclosed herein.

Preferred features include using polyester polymer as the material for the synthetic polymer of the fiber and/or the characteristic polymer material, and preferably for both.

DETAILED DESCRIPTION OF THE INVENTION

Figure 1:
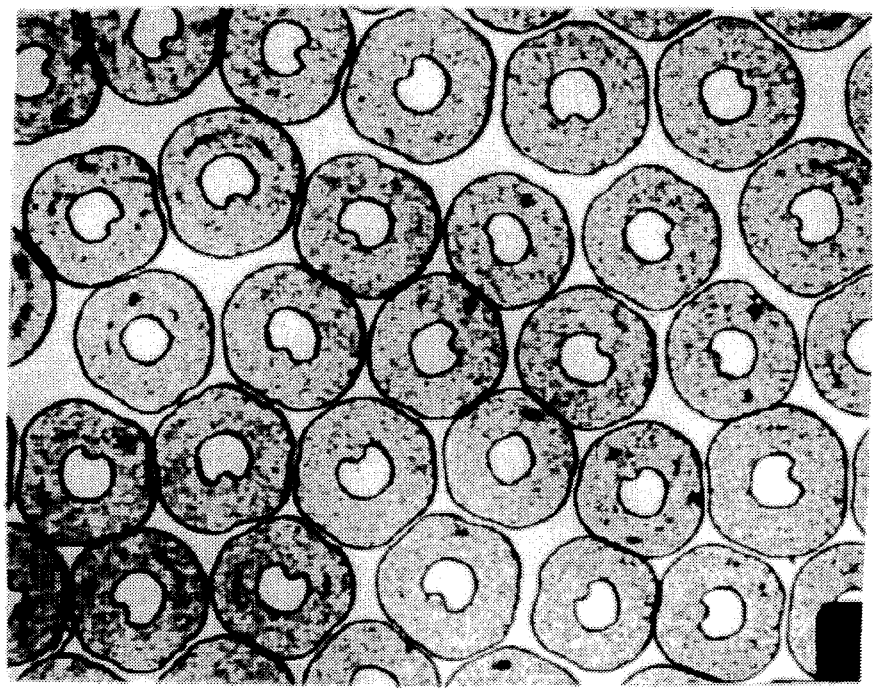
FIGS. 1–4 are magnified photographs of cross-sections of as-spun filaments according to the invention, as described hereinafter.

In most respects, the fiberfill filling material and resilient crimped hollow filling fibers of the invention are prepared conventionally by methods known in the art, such as referred to herein. Preferred hollow fibers are prepared from polyester polymers, especially poly(ethylene terephthalate), and this preferred embodiment is described herein more particularly, for convenience, it being understood that appropriate modification can be made by those skilled in the art for other synthetic polymers, such as polyamides or polypropylene, to take account of their differences, e.g., in melting conditions and properties, such as melt viscosity. One such disclosure in the art is Tolliver U.S. Pat. No. 3,772,137, which discloses hollow synthetic filaments and a spinneret capillary for spinning such filaments containing a single continuous void from synthetic polymers, including polyesters, in FIGS. 1, 3 and 5 thereof.

Figure 5:
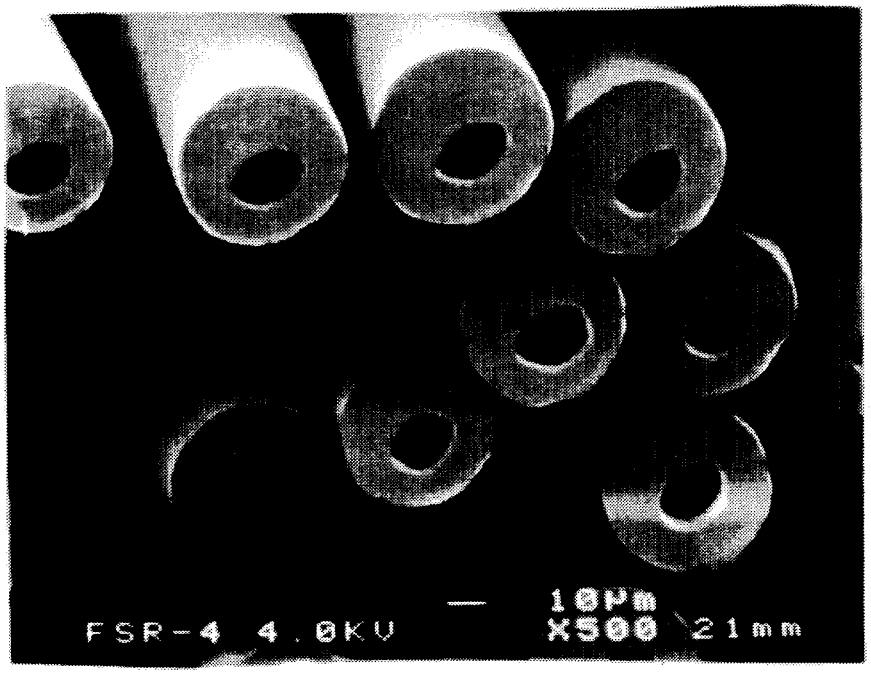
FIG. 5 is a magnified photograph of cross-sections of conventional hollow as-spun filaments according to the prior art.
Figure 6:
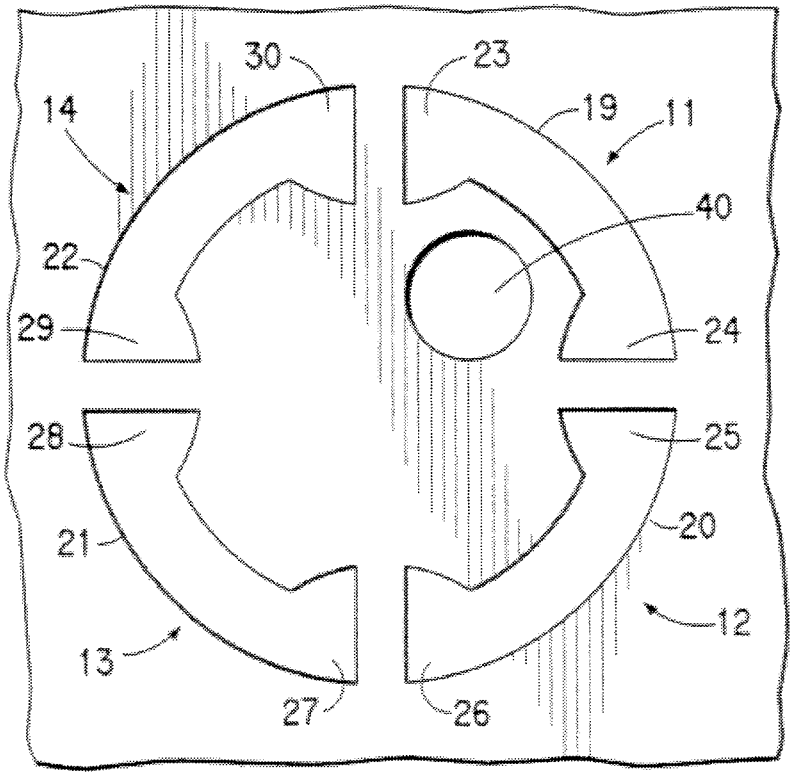
FIG. 6 is an enlarged view of a spinneret capillary, taken looking at the lower face of the spinneret, for spinning preferred filaments of the invention as in FIGS. 1–4.

Referring to FIG. 6 of the accompanying drawings, showing an enlarged view of a spinneret capillary for spinning filaments of the present invention, the similarity to that of FIG. 5 of Tolliver will be noted. The capillary is formed of four individual segments designated generally 11, 12, 13 and 14 in the form of peripheral slots 19, 20, 21, 22 that are curved to form arcs of an incomplete circle. At each end of each peripheral slot, 19, 20, 21 and 22, are "tabs" 23 and 24, 25 and 26, 27 and 28, and 29 and 30, respectively, being enlarged ends of said slot to assist in post-coalescence of the emerging molten polymer to form the desired hollow solid filament, as is known in the art, such as Tolliver, U.S. Pat. No. 3,772,137. An important and novel difference in FIG. 6 herein (that differentiates from FIG. 5 of Tolliver) is the provision of an orifice 40. Molten polymer extruded through orifice 40 solidifies and coalesces on the internal wall of the hollow filament formed by post-coalescence of molten polymer extruded through slots 11, 12, 13 and 14, to form an identifying protuberance protruding into the void on the internal wall of the identifier fiber. The relative location of the protuberance may vary along a length of the filament, as will be understood.

Figure 2:
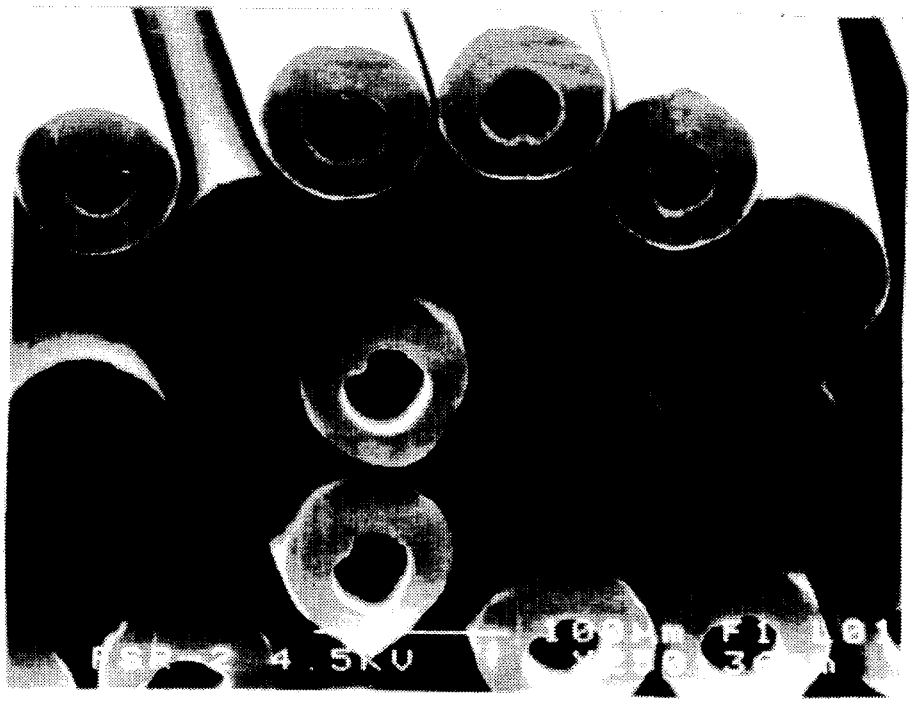
Figure 3:
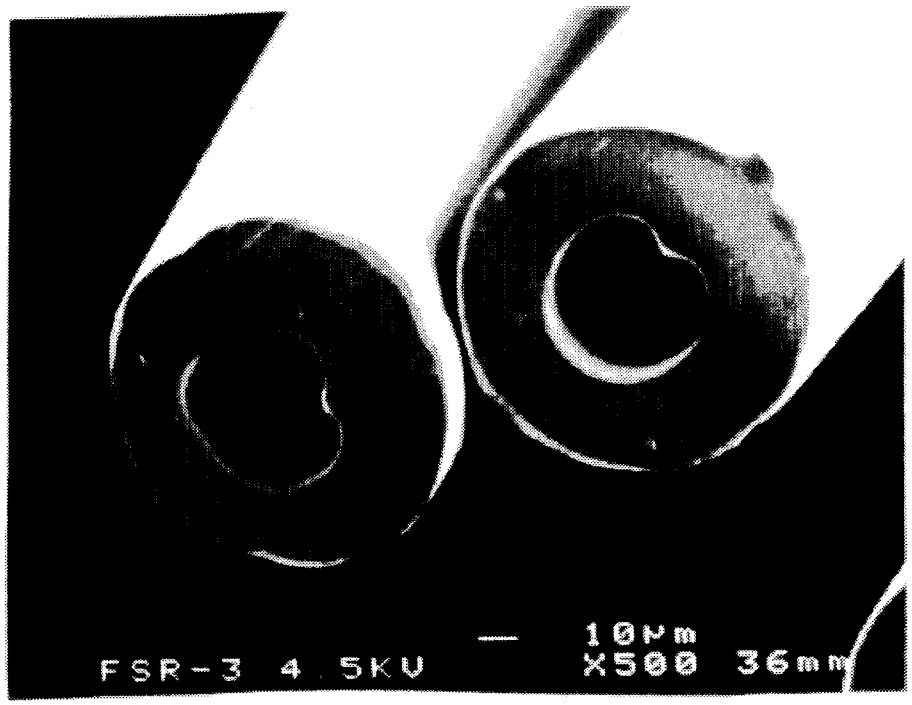
Figure 4:
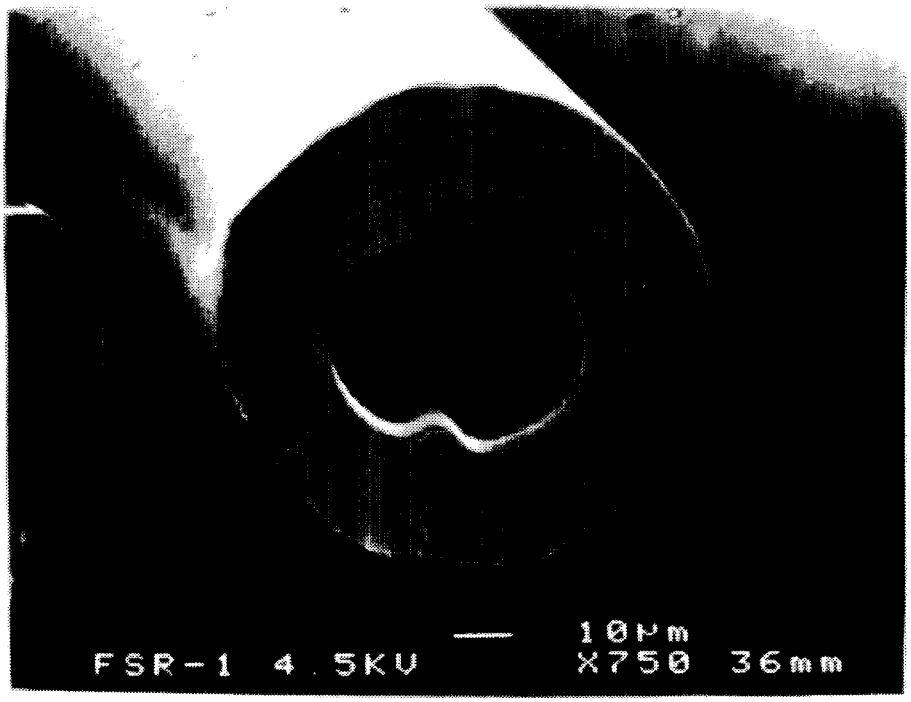

Cross-sections of such hollow identifier as-spun filaments containing a single void with polymer that protrudes from an internal wall into such void, are shown in FIGS. 1–4, in which most of the cross-sections clearly show polymer protruding into the void. Two cross-sections in FIG. 1 (at the left end of the middle horizontal row, and in the horizontal row next below, fourth from the left end) do not clearly show polymer protruding into the void; I believe that those filament cross-sections were actually similar, but that the protruding polymer cannot be seen clearly, perhaps because of the way the filament cross-sections were cut and/or because of the angle of the photograph. Other magnified photographs of cross-sections of identifier filaments are shown in FIGS. 2–4, in which the protuberances can be seen clearly, and in which the magnifications are indicated.

Such identifier filaments have performance and properties as filling materials comparable to that of similar conventional art filaments that do not contain protruding polymer and are shown in FIG. 5. Fiberfill filaments are so fine that, without magnification, it is doubtful that anyone would be able to see any void in the cross-section, or whether the filament is solid, hollow, or multivoid, let alone be able to recognize if any void is partially filled with protruding polymer. In other words, without making magnified cross-sections and examining and comparing them, most people would be unable to determine significant difference between filaments of the invention and conventional filaments of the art. So the object of the invention has been achieved economically by use of a different spinneret capillary to give different cross-sectional configuration internally, without affecting the exterior of the filament or its performance.

The photographs in FIGS. 1–4 show how the filament cross-sections of fiberfill according to my invention differ from those disclosed by Moriguchi (referred to hereinbefore; page references hereinafter to Moriguchi are to pages of the translation provided). Moriguchi disclosed hollow fibers having an almost round hollow section, where a protruding part was provided in the hollow section, where the degree of hollowness was 15–40%, preferably 20–30%, and the degree of irregularity of the hollow part was 5–25%, preferably 10–20% (top of page 7; Moriguchi defined these terms on page 5; Moriguchi's degree of hollowness is similar to the void content, but his degree of hollowness was apparently calculated from actual measurements on cross-sections, as he disclosed on page 9, whereas my void contents are measured by a flotation method). Moriguchi's protruding part had a high degree of irregularity and had an effect on bulkiness (middle of page 4, top of page 5, middle and bottom of page 6, bottom of page 7, and after Table 1 on page 10). Moriguchi stated that the crimping state of his fibers was more three-dimensional than that of conventional hollow fibers (bottom of page 7, for example). In Table 1 (page 9), Moriguchi confirmed this by showing his "Example" fibers (items 2, 3 and 4) had degrees of irregularity of 5, 17 and 25 and their bulkiness values were 3100, 3300 and 2900, respectively, (and their degrees of hollowness, respectively, were 30, 23 and 18), "rivaling" that (3200) of "composite crimped yarn" for the Reference Example (item 6, degree of hollowness 17), in contrast to 2700 and 2500 for the "Comp. Ex." items 1 and 5, respectively, having degrees of irregularity 1 and 52 (and degrees of hollowness 35 and 7). In contrast, the performance of my fibers is the same as that of similar fibers without any protuberance. The protuberance in a fiber according to my invention does not have any effect on performance (such as bulk properties) but shows up visually when the (magnified) cross-section is examined, so the fiber acts as a (visual) identifier without affecting performance. Although it has proved convenient to refer to Moriguchi's degree of irregularity, I would have preferred to have avoided using an area-based relationship, because I prefer to make a protuberance that is visually like a sudden blip, as a longer wall section with gradual thickening is not as easy to see visually, and so would not be as desirable for me. I did, however, measure the degree of irregularity for the cross-sections in my figures and they are only about 1.5%, i.e., far below Moriguchi's lowest limits of at least 5%, preferably at least 10%, which Moriguchi preferred to get his effect on bulkiness.

It will generally be desirable for the protuberance to extend significantly and detectably into the void, e.g., to an amount of about 5 or 10% of the average wall thickness of the filament, and not more than 35% of the average wall thickness, bearing in mind the above. A more gentle thickening of the wall is not so easy to detect as a sudden significant blip. The important objective is to have a characteristic that is relatively easy to detect visually, especially when using the same polymer material.

Tolliver disclosed void contents of about 13 percent to about 25 percent for his hollow fibers, and such void contents are suitable and useful for my hollow fibers according to my invention, also. Hollow fibers with void contents of 15–20 percent are especially useful for fiberfilling purposes, and a wider range of void contents up to 30 percent may also be identified by providing protruding material according to my invention. The void content is generally at least 10%, as less may not provide much distinction from solid fibers, but this will likely depend on the desired end-use for the fibers, as a thick wall may sometimes be more important than the void content.

It is not necessary to provide every filament (i.e., 100%) with identifier, but a regulated proportion (e.g., at least about 10% by weight) of particularly-identified filaments may be included, and recorded, for a batch of fiber that is sold. All filaments may, however, be provided with identifier, if desired.

Furthermore, although it is less costly, so generally preferred, to spin filaments from a single polymer, so the polymer material is the same in the protuberance as in the rest of the filament, different polymers may be used, if desired, so as to provide better identification for merges or batches of fiber.

As will readily be understood, my invention lends itself to many variations. For instance the number and pattern of protuberance(s) in relation to the void may be varied, to some limited extent, bearing in mind that it is generally desirable to maximize the void content to take advantage of the presence of the void.

The invention is further illustrated in the following Example, all parts and percentages being by weight, unless otherwise indicated. The levels of coatings (slickeners and finishes) applied to the filaments were OWF (with regard to the weight of the fiber). Relative Viscosity (sometimes referred to as LRV) and void content (by volume, by a flotation method) were determined by the methods referred to in U.S. Pat. No. 4,712,988 (Broaddus et al.). Bulk measurements are the way the performance of fiberfill is generally assessed and were determined by the method referred to in Tolliver U.S. Pat. No. 3,772,137. Crimp properties were also measured essentially as described by Tolliver.

EXAMPLE

Fiberfill was cut from filaments spun from poly(ethylene terephthalate) of relative viscosity of 20.4 at a polymer temperature of 291° to 297° C. at 1277 ypm (1167 mpm) through a spinneret with 363 capillaries with a throughput per capillary of 0.278 lbs./hr. (0.126 kg./hr.), using orifices as shown in FIG. 6. The filaments were assembled to form a rope of 922,000 relaxed drawn denier. The rope was drawn in a conventional manner, using a draw ratio of 3.5X in a hot, wet spray draw zone maintained at about 95° C. The drawn filaments were crimped in a conventional stuffer box crimper (3.5 in, 8.9 cm, size) to a crimp frequency of about 8.5 crimps per inch (about 3.3 crimps per cm), so as to obtain a Support Bulk (bulk at 0.2 psi) of about 0.6 in. (15 mm), and the crimped rope was relaxed in an oven at 180° C. The fiber had been slickened before relaxing with a finish containing about 1% silicone by weight of fiber to provide an average friction of 0.30. A conventional antistatic overlay finish of about 0.07% by weight was applied. The fibers were found to have an average void content of about 18% and a denier per filament of about 6. The outside periphery of the fiber was round and smooth.

The as-spun filaments of the invention have cross sections as shown in FIGS. 1–4. The filaments contain single continuous voids. On the inside peripheries of these voids there are protuberances which serve as an identification mark. As will be seen from the following comparison, the performance as filling material (in particular the bulk properties) of these fibers of the invention as filling material was essentially similar to that of conventional fibers that were similar (except for the absence of protruding material acting as a visual identification mark).

COMPARISON

The above fiberfill was compared with current conventional slickened (similarly about 1%) hollow products of the same denier (about 6) and average void content (about 18%), spun using a conventional capillary (as shown in FIG. 6 but without orifice 40, i.e., more or less as shown by Tolliver in FIG. 5 of U.S. Pat. No. 3,772,137), and crimped similarly to a crimp frequency of about 8.75 crimps per inch (about 3.4 crimps per cm), to provide a similar Support Bulk level of 0.59 in. (15 mm). These conventional filaments (as-spun) have a cross section as shown in FIG. 5. These cross sections are different from those of the invention, in that they do not contain the fiber identification marker protruding from the internal wall into the void.

Figure 7:
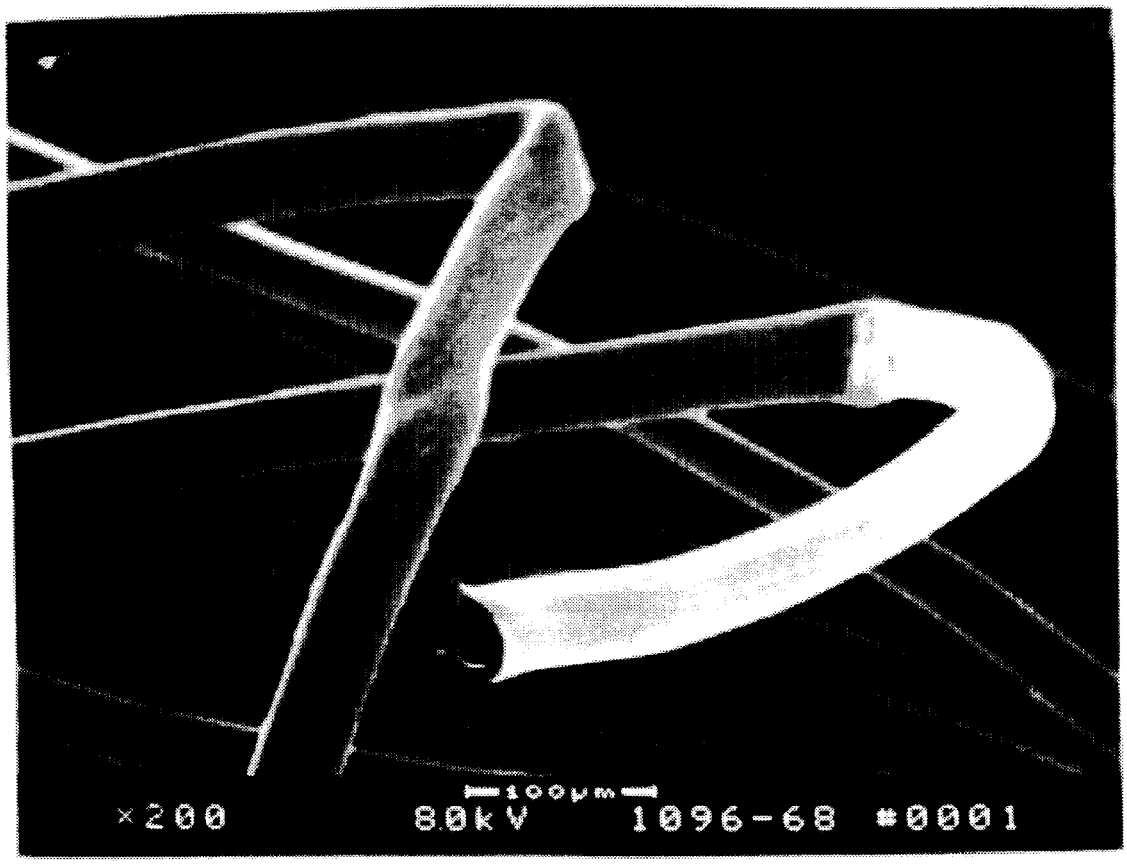
FIG. 7 is a magnified photograph showing preferred fibers of the invention, and not only a cross-section, but also that these fibers are crimped, as described later herein.

In the above comparative test, where the bulkiness of fiberfill comprising identifier fibers of the invention was compared with the bulkiness of fiberfill comprising fibers of similar cross-section except that the void was clear (i.e., without identifier), the crimping of each set of fibers that were compared was carried out in the same stuffer-box machine under the same conditions (using the same velocity, temperature profile and pressures). FIG. 7 is a magnified photograph of crimped hollow fibers according to the invention, showing a hollow cross-section that is somewhat similar to the (magnified) photographs in FIGS. 1–4, except that more of the fiber can be seen so this photograph can show that this fiber has indeed been crimped conventionally, using such a stuffer-box.

The hollow fibers of the invention may be processed into products such as batts and fiberballs (sometimes referred to as clusters) and further processed into pillows, filled apparel, comforters, cushions and like bedding and furnishing material, as disclosed in the art, including that specifically mentioned herein, and art such as LeVan, U.S. Pat. Nos. 3,510,888 and 4,999,232 and various Marcus patents, including U.S. Pat. Nos. 4,618,531, 4,783,364, 4,794,038, 4,818,599, 4,940,502, and 5,169,580, and U.S. Pat. No. 5,088,140 (Belcher et al). Although, hitherto, most fiberfill has comprised cut fiber, such as has been disclosed above, there has been growing commercial interest in using deregistered tows of continuous filaments as fiberfill, as disclosed for example by Watson in U.S. Pat. Nos. 3,952,134 and 3,328,850. Accordingly, application of the invention to fiberfill in the form of deregistered tows of continuous filaments is also contemplated herein, and the invention is not confined to cut fibers nor to fiberfill comprising such cut fibers. Additionally, as well understood in the art, it has been commonplace to mix or blend fibers for use as filling material. Accordingly, it is contemplated that fiberfill according to the invention may consist essentially entirely of identifier fibers according to the invention, or these identifier fibers may be mixed with other fibers; thus, the fiberfill filling material may be identified by all or a portion of its fibers being such identifier fibers. Fiberfill, as is well understood by those skilled in the art, is shorthand for fiberfill filling material, or more shortly fiberfilling material, and refers to a bulky mass of fibers used to fill articles, such as pillows, cushions and other furnishing materials, including other bedding materials, such as sleeping bags, mattress pads, quilts, comforters, duvets and the like, and in apparel, such as parkas and other insulated articles of apparel, whether quilted or not. Crimp is an important characteristic and provides the bulk that is an essential requirement for fiberfill. Generally, the fibers are crimped by mechanical means, usually in a stuffer-box crimper, as described, for example, in Halm et al. in U.S. Pat. No. 5,112,684. Crimp can also be provided by other means, such as asymmetric quenching or using bicomponent filaments as reported, for example, by Marcus in U.S. Pat. No. 4,618,531 and in U.S. Pat. No. 4,794,038, and in the literature referred to therein, so as to provide "spiral crimp". All this is well understood by those skilled in this art.

I claim:

1. Hollow fibers that are of a synthetic polymer, and that have a single continuous void throughout their fiber length, a void content of up to 30%, and a hollow cross-section that shows characteristic polymer material that protrudes into the single continuous void from an inside surface of the single continuous void, said hollow cross-section having a degree of irregularity (as defined herein) of less than 5%.

2. A fiber according to claim 1, wherein said synthetic polymer is polyester.

3. A fiber according to claim 1, wherein said synthetic polymer is polyester and said characteristic polymer material is also a polyester.

4. A fiber according to claim 3, wherein the polyester of said characteristic polymer material is the same as that of said synthetic polymer.

* * * * *